US008257038B2

(12) United States Patent
James

(10) Patent No.: US 8,257,038 B2
(45) Date of Patent: Sep. 4, 2012

(54) METAL INJECTION JOINING

(75) Inventor: Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1523 days.

(21) Appl. No.: 12/024,326

(22) Filed: Feb. 1, 2008

(65) Prior Publication Data

US 2009/0196761 A1 Aug. 6, 2009

(51) Int. Cl.
*F04D 29/34* (2006.01)

(52) U.S. Cl. ..... 415/215.1; 416/193 A; 416/213 R

(58) Field of Classification Search ..... 415/200, 415/209.3, 209.4, 210.1, 215.1; 416/193 A, 416/213 R, 239
See application file for complete search history.

(56) References Cited

U.S. PATENT DOCUMENTS

| | | | | |
|---|---|---|---|---|
| 2,807,435 | A * | 9/1957 | Howlett et al. | 416/241 R |
| 4,538,331 | A | 9/1985 | Egan et al. | |
| 4,592,120 | A | 6/1986 | Egan et al. | |
| 4,728,258 | A | 3/1988 | Blazek et al. | |
| 5,069,265 | A | 12/1991 | Blazek | |
| 5,290,143 | A | 3/1994 | Kington et al. | |
| 5,332,360 | A * | 7/1994 | Correia et al. | 415/209.3 |
| 5,554,338 | A | 9/1996 | Sugihara et al. | |
| 5,797,725 | A * | 8/1998 | Rhodes | 415/209.2 |
| 6,217,282 | B1 | 4/2001 | Stanka | |
| 6,409,473 | B1 | 6/2002 | Chen et al. | |
| 6,488,887 | B1 | 12/2002 | Arai et al. | |
| 6,551,551 | B1 | 4/2003 | Gegel et al. | |
| 7,052,241 | B2 | 5/2006 | Decker | |
| 7,185,433 | B2 * | 3/2007 | Miller et al. | 29/889.22 |
| 7,241,416 | B2 | 7/2007 | Sweetland | |
| 7,334,995 | B2 * | 2/2008 | James | 416/193 A |
| 7,862,298 | B2 * | 1/2011 | Cvjeticanin et al. | 415/215.1 |
| 2006/0239825 | A1 | 10/2006 | Rice et al. | |
| 2007/0017817 | A1 | 1/2007 | Mueller et al. | |
| 2007/0202000 | A1 | 8/2007 | Andrees et al. | |
| 2007/0295785 | A1 * | 12/2007 | Budinger | 228/119 |

* cited by examiner

*Primary Examiner* — Nathaniel Wiehe

(57) ABSTRACT

A method of joining a first part together with a second part is disclosed. The method may comprise providing a first part having a first joining portion including a first channel and a second part having a second joining portion including a second channel. The method may further comprise positioning the first part adjacent to the second part such that the first channel and second channel align with one another to define a cavity. The method may still further comprise preparing a mixture comprising at least one of a metal powder and a polymer binder, placing the mixture into the cavity so as to form a preform and solidifying the preform forming a metal element in the cavity. The metal element joins the first part together with the second part.

18 Claims, 5 Drawing Sheets

METAL INJECTION JOINING

FIELD OF THE INVENTION

The present invention relates to a method of joining individual parts together using a mixture of a metal powder and a polymer binder; joining an airfoil/root structure to a platform using a mixture of a metal powder and a polymer binder; and an airfoil/root structure and platform assembly for use in a gas turbine engine.

BACKGROUND OF THE INVENTION

Metal injection molding (MIM) is a powder metallurgy fabrication method that can be used to produce net-shape or near-net-shape components having densities approaching the density of the base material. MIM can be used to produce precision metal components having complex geometric shapes that would otherwise require extensive machining. The finished parts can develop densities of between 96% and 99% of the base material and exhibit mechanical properties near those of the base material in its wrought form.

It is also known to join metallic components together using a bi-casting process. This technique involves pouring molten metal into a cavity between the components to be joined. When the metal solidifies, the resulting solid metal in the cavity joins the individual components together. The bi-casting process requires that the individual parts be heated to a high temperature to insure that the molten metal does not solidify prematurely during the casting process.

SUMMARY OF THE INVENTION

In accordance with a first aspect of the present invention, a method of joining a first part to a second part is provided. The method may comprise providing a first part having a first joining surface including a first channel, providing a second part having a second joining portion including a second channel, positioning the first part adjacent to the second part such that the first channel and the second channel align with one another to define a cavity, preparing a mixture comprising at least one of a metal powder and a polymer binder, placing the mixture in the cavity so as to form a preform and solidifying the preform forming a metal element in the cavity, wherein the metal element joins the first part together with the second part.

The method may further comprise placing a polymer insert into a predetermined location in the first channel or the second channel prior to placing the mixture into the cavity and solidifying the preform may comprise heating the polymer insert to remove the polymer insert, wherein the metal element occupies at least part of the predetermined location in the first channel or the second channel.

In accordance with a second aspect of the present invention, a method of joining an airfoil/root structure to a platform is provided. The method may comprise providing an airfoil/root structure having a first joining portion, providing a platform having a second joining portion, positioning the airfoil/root structure adjacent to the platform such that the first joining portion and the second joining portion align with one another, providing a metal powder and polymer binder preform adjacent to the first joining portion and the second joining portion, and solidifying the preform forming a metal element, wherein the metal element joins the airfoil/root structure together with the platform.

Providing a metal powder and polymer binder preform adjacent to the first and second joining portions may comprise preparing a mixture comprising a metal powder and a polymer binder, placing an external mold adjacent to the first and second joining portions and injecting the mixture into the cavity to form a preform.

Providing a metal powder and polymer binder preform adjacent to the first and second joining portions may comprise metal injection molding a metal powder and polymer preform ring and placing the preform ring adjacent to the first and second joining portions.

In accordance with another aspect of the present invention, an airfoil/root structure and platform assembly for use in a gas turbine engine is provided. The airfoil/root structure and platform assembly may comprise an airfoil/root structure including a first joining portion and a platform including a second joining portion. The second joining portion is aligned with the first joining portion to define a cavity. The assembly may yet comprise a metal injection molded element within the cavity, wherein the metal element cooperates with the first and second joining portions to join the airfoil/root structure to the platform. The second joining portion may be configured to align with the first joining portion to define a cavity having an open side and the metal element may comprise a metal injection molded preform ring located in the cavity.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1A:
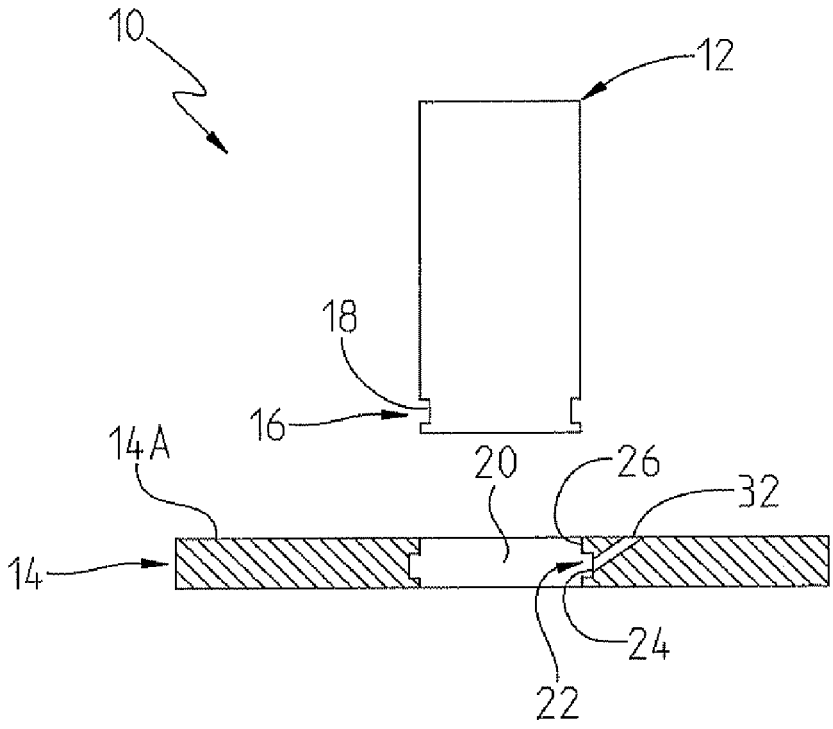
FIG. 1A is a diagrammatic illustration of a first part positioned proximate to a second part in preparation for joining in accordance with an aspect of the present invention.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention Referring now to FIGS. 1A, 1B and 1C, an assembly 10 constructed in accordance with an embodiment of the present invention is illustrated diagrammatically. The assembly 10 comprises a first part 12 joined to a second part 14. The first part 12 comprises a first joining portion 16 including a first channel 18, see FIG. 1A. The first joining portion 16 and the first channel 18 may extend substantially around a perimeter of the first part 12.

Figure 1B:
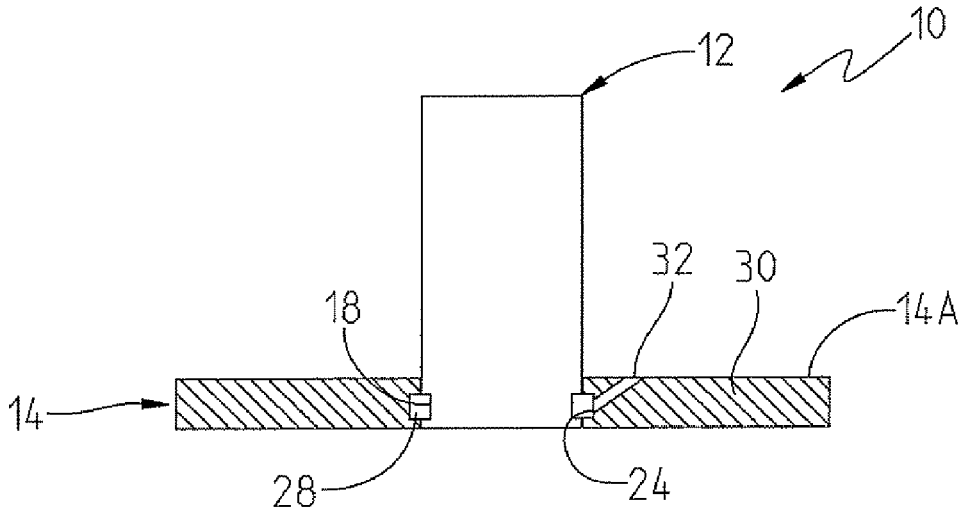
FIG. 1B is a diagrammatic illustration of the first part and second part of FIG. 1A positioned in position for joining.
Figure 1C:
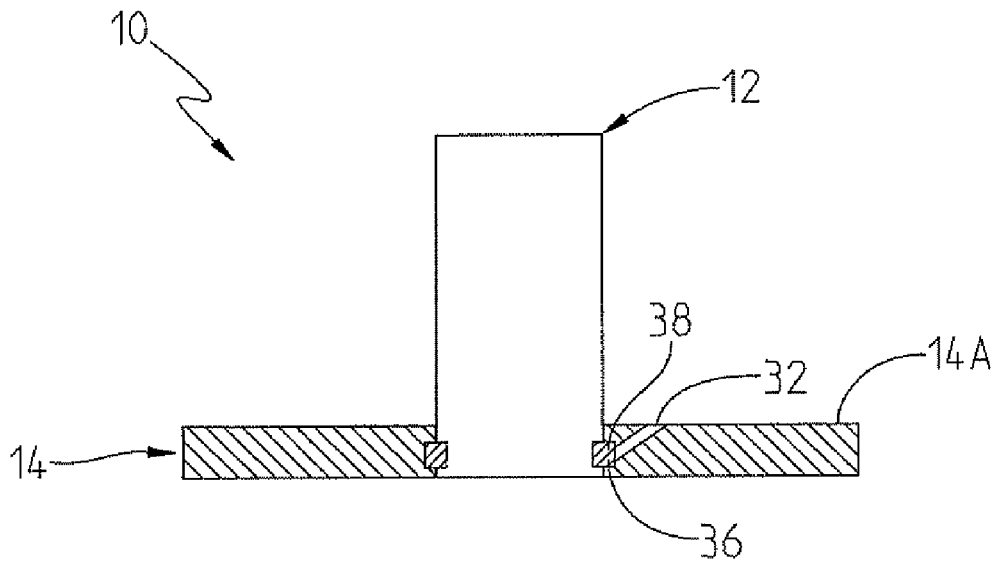
FIG. 1C is a diagrammatic illustration of the first part and second part of FIGS. 1A and 1B joined together in accordance with an aspect of the present invention.

The second part 14 is shown diagrammatically in FIGS. 1A, 1B and 1C as a single continuous part. The second part 14 includes an aperture 20 extending through the second part 14 and configured to receive the first part 12. The second part 14 may further comprise a second joining portion 22 including a second channel 24. The second joining portion 22 and the second channel 24 may extend substantially around an interior surface 26 of the second part 14 formed by the aperture 20.

The first part 12 and second part 14 may be made of any suitable material such as, for example, a metal alloy.

When the first part 12 is positioned within the aperture 20 in the second part 14, the first joining portion 16 of the first part 12 is positioned adjacent to the second joining portion 22 of the second part 14 such that the first channel 18 aligns with the second channel 24 to define a cavity 28, see FIG. 1B. The cavity 28 may extend substantially around the perimeter of the first part 12. A port 32 extends from an outer surface 14A of the second part 14 to the channel 24. A further port (not shown) may be provided to release air from the cavity 28 when the cavity 28 is being filled with a metal powder/polymer binder mixture, which filling operation is discussed in detail below.

A metal element may be formed in the cavity 28 by a suitable process such as metal injection molding so as to join the first part 12 to the second part 14. For example, a mixture comprising a metal powder, such as a low allow steel or a nickel base alloy and a thermoplastic polymer binder such as polypropylene or polyethylene may be prepared and placed into the cavity 28 through the port 32. The mixture may comprise about 60 percent metal powder by volume and about 40 percent thermoplastic polymer binder by volume, and may be hot mixed, for example, at a temperature failing within a range of from about 140 degrees C. to about 200 degrees C., to produce a viscous homogeneous mixture. The mixture may then be placed into the cavity 28 via the port 32 using any suitable means such as, for example, injecting under high pressure. The first part 12 and second part 14 may be heated to a temperature of about 150 degrees C. while the mixture is being injected into the cavity 28 such that the mixture flows freely into the cavity 28 such that the cavity 28 is substantially filled with the mixture. The mixture may then be allowed to cool inside the cavity 28 where it forms a rigid preform 36 substantially conforming to the shape of the cavity 28, see FIG. 1C.

It is also anticipated that the mixture may be poured into the cavity 28 in the form of a loose metal powder without a polymer binder. The first part 12 and the second part 14 may be vibrated while the loose metal powder is poured into the cavity 28 so that the powder flows freely into the cavity 28 and substantially fills the cavity 28. It is expected that filling the cavity 28 with a metal powder without a polymer binder will result in less shrinkage of the powder during a subsequent sintering process.

A substantial portion or all of the polymer binder material is subsequently removed in a debinding process by heating the assembly 10 to a temperature, for example, falling within a range of from about 550 degrees C. to about 650 degrees C., such that substantially all organic material in the polymer binder material pyrolizes and the metal powder partially sinters leaving a partially sintered metal powder in the cavity 28. As the polymer binder material pyrolizes, a gas thus created escapes from the cavity 28 through the port 32 and small spaces between the first joining portion 18 of the first part 12 and the second joining portion 22 of the second part 14. The assembly 10 is subsequently further heated during a final sintering operation to a temperature, for example, of between about 1200 degrees C. and about 1250 degrees C. degrees, depending upon the materials from which the first part 12, the second part 14 and the metal powder are made. The heat removes the remaining polymer binder material not removed during the debinding process and further sinters the metal particles, solidifying the preform 36 and forming a metal element 38 in the cavity 28 that joins or couples the first part 12 together with the second part 14.

During the debinding and sintering process the preform 36 may shrink as much as about 20 percent while maintaining a shape conforming substantially to the interior shape of the cavity 28. The sintering process may be controlled such that the resulting metal element 38 achieves a density that is within a range of between about 95 percent to about 99 percent of a density of the base material in a solid, non-powder form from which the metal powder is made.

The metal powder may be made of a metal having a melting temperature that is lower than a melting temperature of the first part 12 and the second part 14. As a result, the metal element 38 formed in the cavity 28 may also have a melting temperature that is lower than the melting temperature of the first part 12 and the second part 14. This may allow the first part 12 to be separated from the second part 14 at a later time by heating the assembly 10 to a temperature that is higher than the melting temperature of the metal element 38 but lower than the melting temperature of the first part 12 and the second part 14 such that the metal element 38 melts without melting the first part 12 or the second part 14. In this fashion, disassembly or repair of the assembly 10 may be facilitated.

Figure 1D:
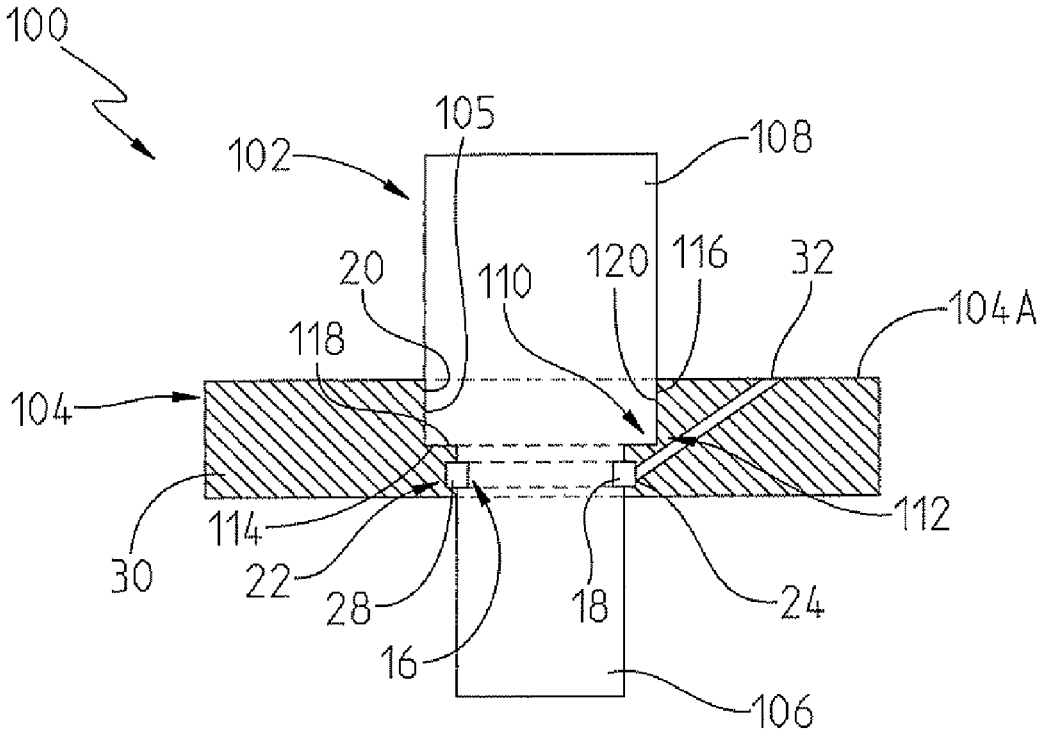
FIG. 1D is a diagrammatic illustration of an airfoil and platform assembly for use in a gas turbine engine constructed in accordance with an aspect of the present invention.

Referring now to FIG. 1D, an airfoil/root structure and platform assembly 100 constructed in accordance with another embodiment of the present invention is illustrated diagrammatically where like elements are referenced by like reference numerals. The assembly 100 is adapted to be used in a gas turbine engine (not shown).

Within the gas turbine are a series of rows of stationary vanes and rotating blades. The blades are coupled to a shaft and disc assembly. Hot working gases from a combustor (not shown) in the gas turbine engine travel to the rows of blades. As the working gases expand through the turbine, the working gases cause the blades, and therefore the shaft and disc assembly, to rotate.

As illustrated in FIG. 1D, the assembly 100 comprises a blade 102 coupled to a platform 104. The blade 102 comprises an attachment portion or a root 106 and an airfoil 108 formed integral with the root 106. The integral airfoil 108 and root 106 define an airfoil/root structure. The root 106 functions to couple the airfoil 108 to the shaft and disc assembly (not shown) in the gas turbine (not shown). The root 106 comprises a first joining portion 16 including a first channel 18. The first channel 18 may extend substantially around a perimeter of the root 106 of the blade 102.

Though the assembly 100 illustrated in FIG. 1D shows a blade 102 joined to a platform 104, it is also contemplated that a vane assembly may be formed in accordance with the present invention wherein an airfoil is coupled to opposing shrouds positioned at opposing ends of the airfoil. Each shroud is coupled to the airfoil via a metal element formed via a metal injection molding process within a cavity defined by opposing channels formed in the airfoil and the corresponding shroud. It is further contemplated that blade/platform and vane assemblies may be formed in accordance with the present invention as discussed herein for use in a compressor of a gas turbine engine.

The platform 104 is shown diagrammatically in FIG. 1D as a single continuous structure. The platform 104 may include a stepped aperture 20 extending through the platform 104 and configured to receive the blade 102. The platform 104 may also include a second joining portion 22 including a second channel 24. The second channel 24 may extend substantially around an interior surface 105 of the platform 104 defining the stepped aperture 20. The blade 102 and the platform 104 may be made from a suitable material such as a metal alloy.

When the blade 102 is inserted into the stepped aperture 20, such that the first joining portion 16 of the root 106 is positioned adjacent to the second joining portion 22 in the platform 104, the first channel 18 aligns with the second channel 24 to define a cavity 28. The cavity 28 may extend substantially around the perimeter of the root 106. A port 32 extends from an outer surface 104A of the platform to the channel 24. A further port (not shown) may be provided to release air from the cavity 28 when the cavity 28 is being filled with a metal powder/polymer binder mixture during a metal injection molding operation.

The blade 102 may be joined to the platform 104 by metal injection molding a metal element 38, see FIG. 1C, in the cavity 28 as previously described with reference to FIGS. 1A, 1B and 1C.

The blade 102 may include a first alignment feature 110 on or near to the first joining portion 16 and the platform 104 may include a second alignment feature 112 on or near to the second joining portion 22. The first alignment feature 110 is configured to cooperate with the second alignment feature 112 such that the first channel 18 aligns with the second channel 24 to define the cavity 28 when the blade 102 is inserted into the aperture 20 of the platform 104 such that the first joining portion 16 is positioned adjacent to the second joining portion 22.

As illustrated in FIG. 1D, the first alignment feature 110 comprises a first surface 114 and a second surface 116 perpendicular to the first surface 114. The second alignment feature 112 includes a third surface 118 and a fourth surface 120 perpendicular to the third surface 118. The third and fourth surfaces 118 and 120 comprise part of the interior surface 105 of the platform 104 which, in turn, defines the stepped aperture 20. The first and second surfaces 114 and 116 are located in known locations relative to the first channel 18, and the third and fourth surfaces 118 and 120 are located in known locations relative to the second channel 24. The first surface 114 rests against the third surface 118 while the second surface 116 rests against the fourth surface 120 when the blade 102 is inserted into the aperture 20 in the platform 104 in position for joining. In this way, the first channel 18 is aligned with the second channel 24 when the blade 102 is positioned in the aperture 20 in position for joining with the platform 104.

Referring now to FIGS. 2A, 2B, 2C and 2D, an airfoil/root structure and platform assembly 200 constructed in accordance with another embodiment of the present invention is illustrated diagrammatically where like elements are referred to by like reference numerals. The platform 104 is not shown in FIG. 2A.

Figure 2A:
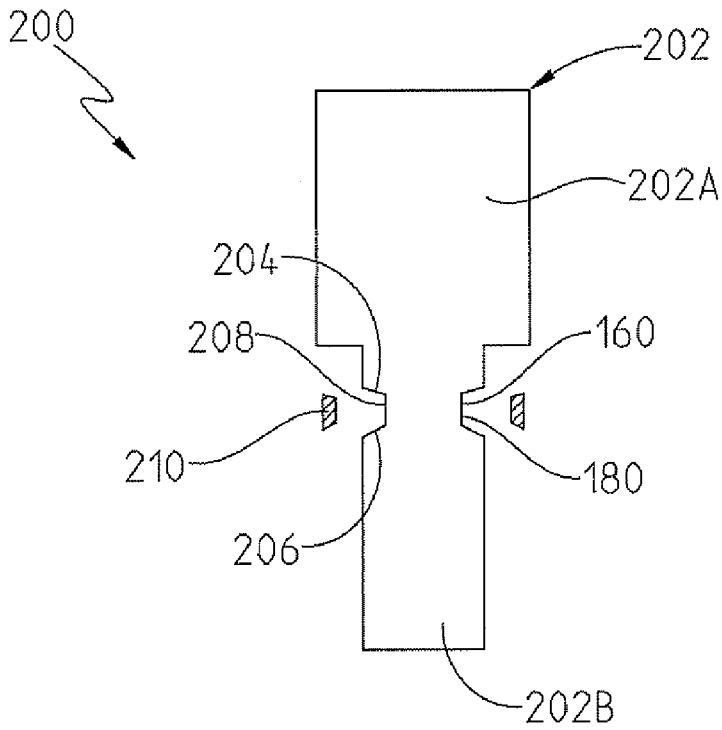
FIG. 2A is diagrammatic illustration of an airfoil/root structure showing an insert positioned for placement within a channel in accordance with an aspect of the present invention.
Figure 2B:
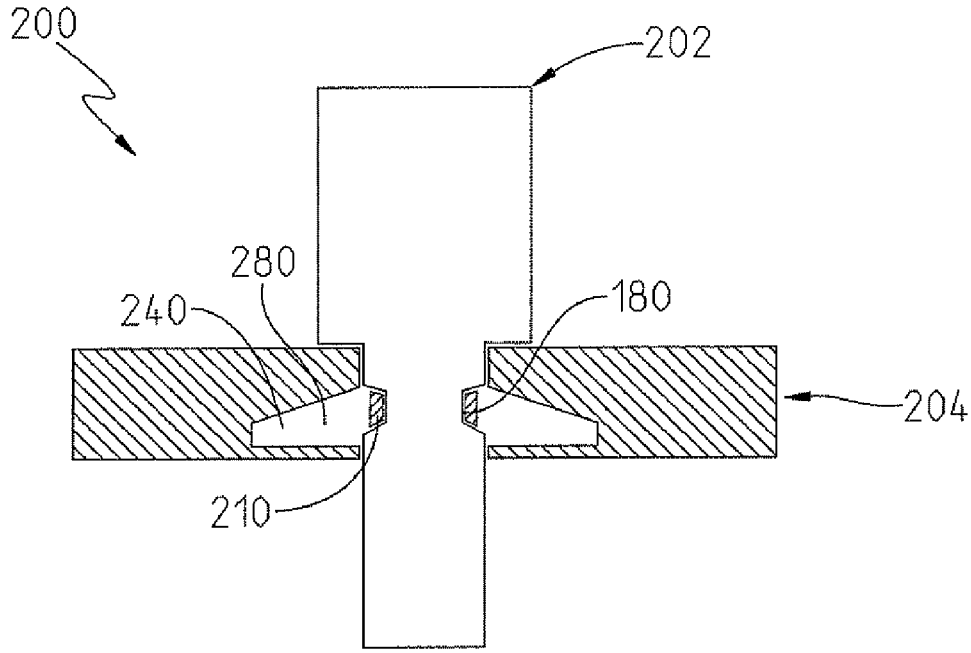
FIG. 2B is a diagrammatic illustration of the airfoil/root structure of FIG. 2A positioned proximate to a platform in preparation for joining showing the insert of FIG. 2A positioned in the channel.
Figure 2C:
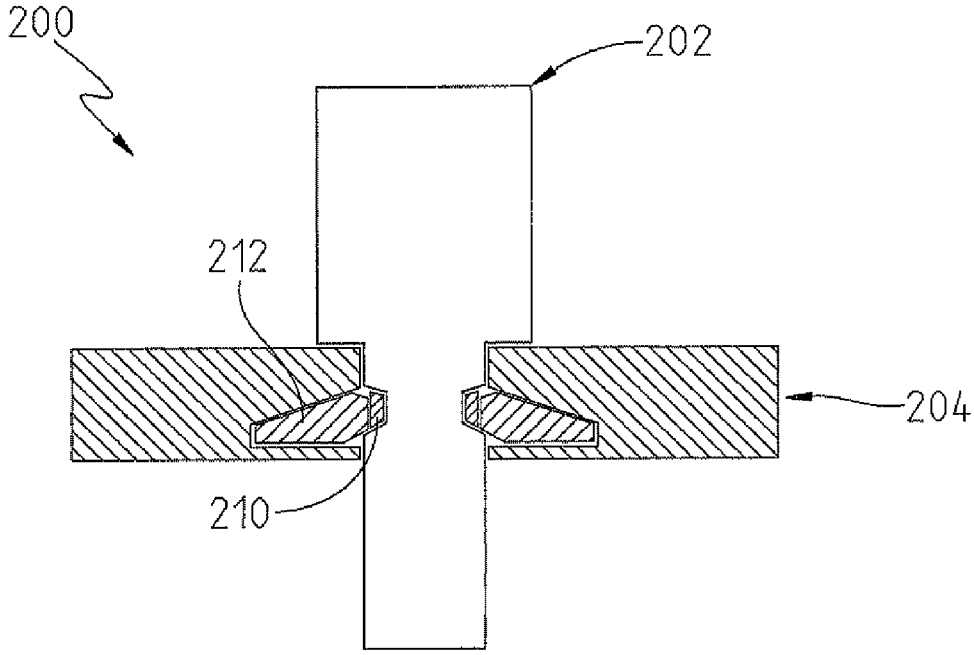
FIG. 2C is a diagrammatic illustration of the airfoil/root structure and platform of FIG. 2B showing a preform within a cavity in preparation for joining in accordance with an aspect of the present invention.
Figure 2D:
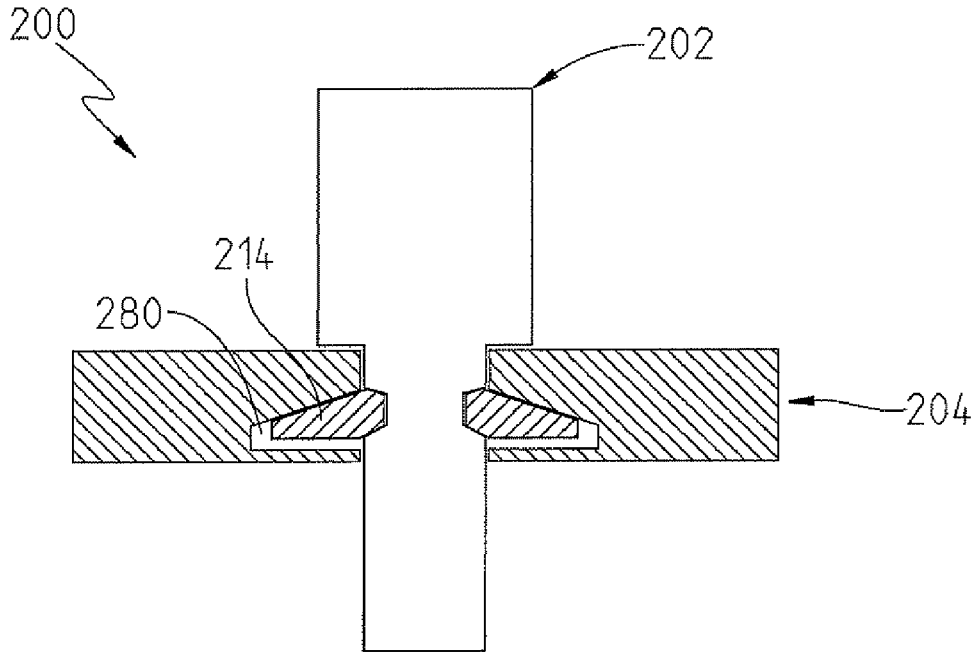
FIG. 2D is a diagrammatic illustration of the airfoil/root structure and platform of FIG. 2C joined in accordance with an aspect of the present invention.

FIG. 2A illustrates an airfoil/root structure 202 comprising an airfoil 202A and a root 202B. The root 202B comprises a first joining portion 160. The first joining portion 160 includes a first channel 180 having a first side 204 and a second side 206 that taper inwardly toward one another and a bottom surface 208 which together with the first and second sides 204 and 206 define the first channel 180 having a cross sectional shape of a truncated V. A polymer insert 210 made, for example, from a pliable polymeric material such as polypropylene or polyethylene, having a trapezoidal shape, is first prepared and then placed into the first channel 180 in a predetermined location. Thereafter, a metal powder and polymer binder mixture is placed into a cavity 280 formed by the first channel 180 and a second channel 240 formed in the platform 204, see FIG. 2B. The second channel 240 in the platform 204 illustrated in FIGS. 2B, 2C and 2D has a trapezoidal shape such that the first channel 180 and the second channel 240 define the cavity 280 having a shape of an irregular polygon when the airfoil/root structure 202 is positioned adjacent to the platform 204 in preparation for joining. As the mixture is placed into the cavity 240, the polymer insert 210 prevents the mixture from occupying the predetermined location in the cavity 280 where the polymer insert 210 is positioned, see FIG. 2C. As a result, the mixture flows only into the space in the cavity 280 not occupied by the polymer insert 210 and forms a preform 212 conforming to this shape, see FIG. 2C.

As previously described with respect to FIGS. 1A, 1B and 1C, the preform 212 is solidified by debinding and sintering. During the solidification process, the polymer insert 210 is heated and removed from the cavity 240 by pyrolysis in the same manner as the polymer binder is removed from the metal powder and polymer binder mixture. Also during the debinding and sintering process, the preform 212 shrinks as the polymer binder is removed from the mixture and the metal powder is sintered as previously described. As the preform 212 shrinks, it is believed that it will move at least partially into the location previously occupied by the polymer insert 210. In this fashion, it is believed that a metal element 214 formed from the sintered perform 212 in the cavity 240 will occupy at least part of the predetermined location previously occupied by the polymer insert 210, see FIG. 2D.

Figure 3:
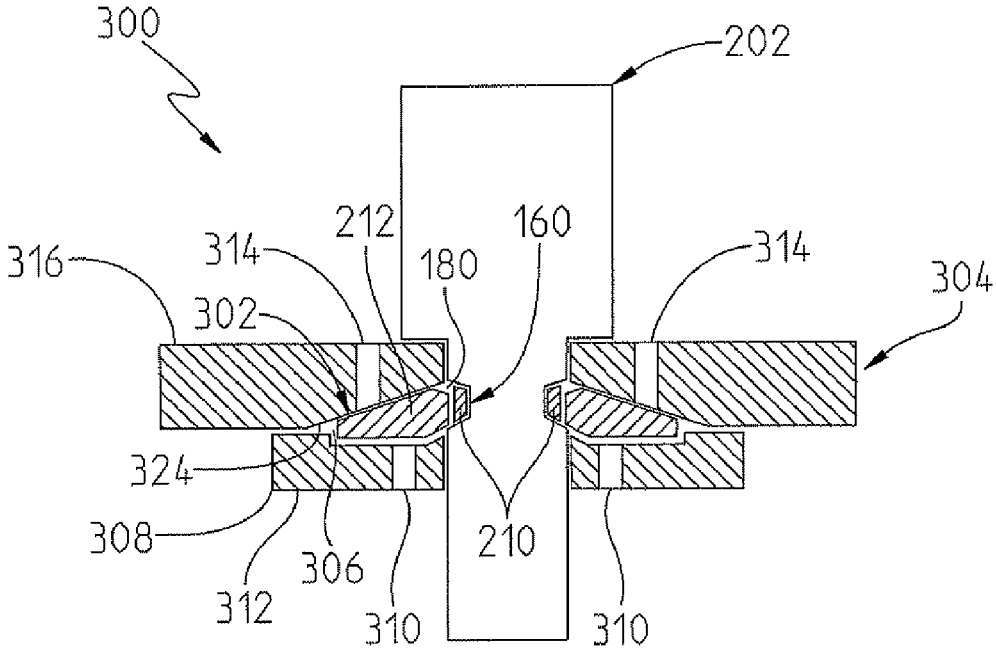
FIG. 3 is a diagrammatic illustration of an airfoil/root structure and a platform showing an external mold section forming a cavity in cooperation with joining portions of the airfoil/root structure and the platform in accordance with an aspect of the present invention.

Referring now to FIG. 3, an airfoil/root structure and platform assembly 300 constructed in accordance with another aspect of the present invention is illustrated diagrammatically where like elements are referred to by like reference numerals. As previously discussed, the airfoil/root structure 202 includes a first joining portion 160 including a first channel 180. A platform 304, as illustrated in FIG. 3, includes a second joining portion 302 including a surface 324 that defines one side of a mold cavity 306. When the airfoil/root structure 202 is positioned adjacent to the platform 304, a mold cavity 306 is defined by the first channel 180, the surface 324 of the second joining portion 302, and an external mold 308 positioned adjacent to the first joining portion 160 of the airfoil/root structure 202 and the second joining portion 302 of the platform 304.

The external mold 308 may optionally include one or more apertures 310 extending through the external mold 308 from an exterior surface 312 and connecting with the interior of the mold cavity 306. Alternatively, one or more apertures 314 may be provided in the platform 304 extending through the platform 304 from an exterior surface 316 and connecting with the interior of the mold cavity 306. The mixture may be placed into the mold cavity 306 by, for example, pressure injecting the mixture into the mold cavity 306 through the apertures 310 or 314. In this fashion, a preform 212 may be formed in the mold cavity 306 as previously described. As previously discussed with reference to FIGS. 2A, 2B, 2C and 2D, a polymer insert 210 may optionally be placed into a predetermined location in the first channel 180 prior to placing the mixture into the mold cavity 306.

Once the preform 212 cools and becomes rigid, the external mold 308 may be removed and the preform 212 may be solidified forming a metal element in the mold cavity 306. During the debinding and sintering process, i.e., the solidifying process, the polymer binder is removed from the preform 212 and, optionally, the polymer insert 210 is removed from the first channel by pyrolysis as previously described. As the polymer pyrolizes from the mixture and, optionally, the polymer insert 210, the gas thus created escapes from the mold cavity 306. Removal of the external mold 308 prior to the debinding and sintering processes exposes the preform 212 to the atmosphere on the surface defined by the external mold 308 allowing the gas to more easily escape from the mold cavity 306.

Figure 4:
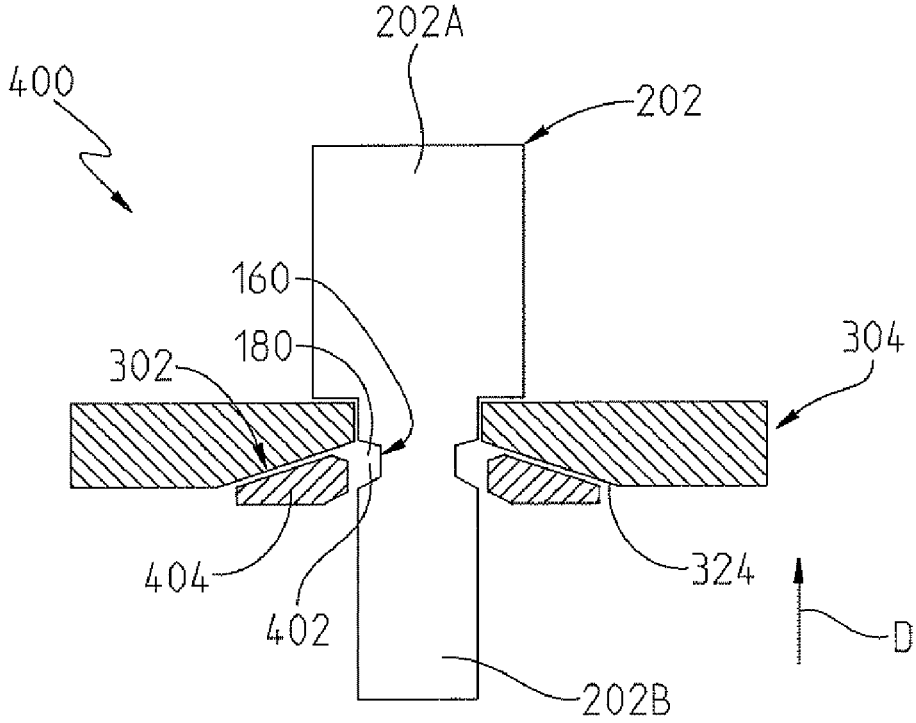
FIG. 4 is a diagrammatic illustration of an airfoil/root structure and a platform showing a metal injection molded preform ring positioned proximate to a cavity formed by joining portions of the airfoil/root structure and the platform in accordance with an aspect of the present invention.

Referring now to FIG. 4, an airfoil/root structure and platform assembly 400 constructed in accordance with another aspect of the present invention is illustrated diagrammatically where like elements are referred to by like reference numerals. The assembly 400 is similar to the assembly 300 illustrated in FIG. 3 without the external mold 308. A cavity 402 defined by the channel 180 of the first joining portion 160 of the airfoil/root structure 202 and the second joining portion 302 of the platform 304 is open opposite to the surface 324. A preform ring 404 may be prepared by a process such as, for example, metal injection molding in a mold separate from the assembly 400. The preform ring 404 may be molded into a continuous ring having a shape conforming generally to a perimeter of the root 202B of the airfoil/root structure 202 and may have a circumference sized to extend completely around the root 202B of the airfoil/root structure 202 The preform ring 404 may be prepared in a rigid green state such that it retains its shape while it is subsequently handled.

Once the airfoil/root structure 202 is placed adjacent to the platform 304 in a position for joining, the preform ring 404 may be placed adjacent to the first joining portion 160 and the second joining portion 302 by placing it around the perimeter of the root 202B of the airfoil/root structure 202 and moving it toward the platform 304 in a direction D until it contacts the surface 324 of the second joining portion 302. The preform ring 404 may be subsequently solidified by debinding and sintering as previously described to form a continuous metal element extending completely around the root 202B of the airfoil/root structure 202. During the debinding and sintering process, the preform ring 404 shrinks in both cross section and circumference and moves into the first channel 180 of the first joining portion 160 of the airfoil/root structure 202 thereby joining the airfoil/root structure 202 to the platform 304.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of joining a first part to a second part comprising:

providing a first part having:

a first joining portion including a first channel; and a first alignment feature;

providing a second part having:

a second joining portion including a second channel; and a second alignment feature;

positioning said first part adjacent to said second part such that said first channel and said second channel align with one another to define a cavity, wherein said first alignment feature and said second alignment feature cooperate to align said first channel and said second channel when said first part is positioned adjacent to said second part;

preparing a mixture comprising at least one of a metal powder and a polymer binder;

placing said mixture into said cavity so as to form a preform; and solidifying said preform forming a metal element in said cavity, wherein said metal element joins said first part together with said second part.

2. The method of claim 1, wherein said placing said mixture into said cavity comprises injecting said mixture into said cavity such that said cavity is substantially filled with said mixture.

3. The method of claim 1, wherein:

said preparing a mixture comprising at least one of a metal powder and a polymer binder comprises preparing a mixture comprising a loose metal powder; and said placing said mixture into said cavity comprises vibrating said first part and said second part and pouring said mixture into said cavity such that said cavity is substantially filled with said mixture.

4. The method of claim 1, further comprising heating said first part and said second part to a predetermined temperature such that said mixture flows freely into said cavity.

5. The method of claim 1, wherein said preparing a mixture comprises preparing a mixture comprising a metal powder comprising metal particles having a melting temperature that is lower than a melting temperature of said first part and said second part, wherein said metal element has a melting temperature that is lower than a melting temperature of said first part and said second part.

6. The method of claim 1, further comprising placing a polymer insert into a predetermined location in said first channel or said second channel prior to placing said mixture into said cavity; and said solidifying said preform comprises heating said polymer insert to remove said polymer insert, wherein said metal element occupies at least part of said predetermined location in said first channel or said second channel.

7. The method of claim 1, wherein:

said preparing a mixture comprises preparing a mixture comprising a metal powder comprising metal particles having a first density; and said solidifying said preform forming a metal element in said cavity comprises solidifying said preform forming a metal element in said cavity having a second density, wherein said second density is within a range of between about 95% and about 99% of said first density.

8. The method of claim 1, wherein:

said cavity comprises a mold cavity; and said placing said mixture into said cavity comprises injecting said mixture into said mold cavity.

9. A method of joining an airfoil/root structure to a platform comprising:

providing an airfoil/root structure having a first joining portion;

providing a platform having a second joining portion;

positioning said airfoil/root structure adjacent to said platform such that said first joining portion and said second joining portion align with one another;

providing a metal powder and polymer binder preform adjacent to said first and second joining portions comprising:

preparing a mixture comprising a metal powder and polymer binder;

placing an external mold adjacent to said first and second joining portions to define a cavity with said first and second joining portions; and injecting said mixture into said cavity to form said preform; and solidifying said preform forming a metal element, wherein said metal element joins said airfoil/root structure together with said platform.

10. The method of claim 9, wherein:

said first joining portion includes a first channel;

said second joining portion includes a second channel; and said positioning comprises placing said airfoil/root structure adjacent to said platform such that said first and second channels align to define said cavity with said mold.

11. The method of claim 10, further comprising placing a polymer insert into a predetermined location in said first channel prior to placing said mixture in said cavity; and said solidifying said preform comprises heating said polymer insert to remove said polymer insert, wherein said metal element occupies at least part of said predetermined location in said first channel.

12. The method of claim 9, wherein said preparing a mixture comprises preparing a mixture comprising a metal powder comprising metal particles having a melting temperature that is lower than a melting temperature of said airfoil/root structure and said platform, wherein said metal element has a melting temperature that is lower than a melting temperature of said airfoil/root structure and said platform.

13. The method of claim 9, wherein providing a metal powder and polymer binder preform adjacent to said first and second joining portions further comprises:

metal injection molding a metal powder and polymer binder preform ring; and placing said preform ring adjacent to said first and second joining portions.

14. An airfoil/root structure and platform assembly for use in a gas turbine engine comprising:

an airfoil/root structure including a first joining portion;

a platform including:

a second joining portion, said second joining portion being aligned with said first joining portion to define a cavity; and at least one port that extends through said platform from an outer surface of said platform to said second joining portion; and a metal injection molded metal element that is inserted into said cavity through said at least one port while in a viscous or powder state, wherein said metal element cooperates with said first joining portion and said second joining portion to join said airfoil/root structure to said platform upon said metal element being solidified.

15. The airfoil/root structure and platform assembly of claim 14, wherein:

said second joining portion is configured to align with said first joining portion to define a cavity having an open side; and said metal element comprises a metal injection molded preform ring located in said cavity.

16. The airfoil/root structure of claim 14, wherein said metal element has a melting temperature that is lower than a melting temperature of said airfoil/root structure and said platform.

17. The airfoil/root structure of claim 14, further comprising a polymer insert positioned in a predetermined location in said cavity prior to inserting said metal element in said cavity, wherein:

said polymer insert is removed from said cavity upon solidification of said metal element; and said metal element occupies at least part of said predetermined location in said cavity after said polymer insert is removed.

18. The airfoil/root structure of claim 14, wherein:

said airfoil/root structure comprises a first alignment feature;

said platform comprises a second alignment feature; and said first alignment feature and said second alignment feature cooperate to align said first joining portion and said second joining portion to define said cavity.

* * * * *